United States Patent [19]

Yamagata et al.

[11] 3,978,648

[45] Sept. 7, 1976

[54] HELICALLY WRAPPED YARN

[75] Inventors: Seiichi Yamagata; Kozo Susami, both of Otsu, Japan

[73] Assignee: Toray Industries, Inc., Tokyo, Japan

[22] Filed: Apr. 9, 1974

[21] Appl. No.: 459,396

[30] Foreign Application Priority Data

Apr. 10, 1973 Japan ..... 48-39991

[52] U.S. Cl. ..... 57/144; 57/5; 57/51; 57/157 F; 57/160

[51] Int. Cl.[2] ..... D02G 3/36; D02G 3/38

[58] Field of Search ..... 57/144, 36, 140 BY, 57/160, 156, 51, 3, 5, 157 F

[56] References Cited

UNITED STATES PATENTS

| | | | |
|---|---|---|---|
| 3,079,746 | 3/1963 | Field, Jr. | 57/51 |
| 3,365,872 | 1/1968 | Field, Jr. | 57/144 |
| 3,487,619 | 1/1970 | Field, Jr. | 57/51 |
| 3,643,416 | 2/1972 | Andrews et al. | 57/144 X |
| 3,831,369 | 8/1974 | Northrup et al. | 57/144 |
| 3,835,637 | 9/1974 | Russell | 57/144 X |
| 3,835,639 | 9/1974 | Rhyne | 57/160 X |

*Primary Examiner*—John Petrakes

[57] ABSTRACT

Helically wrapped yarn, having a bundle of substantially parallel core staple fibers, with uniformly helically wrapped staple fibers, and apparatus and method.

8 Claims, 13 Drawing Figures

HELICALLY WRAPPED YARN

BRIEF SUMMARY OF THE INVENTION

The present invention relates to a wrapped yarn having many advantages of a non-twisted spun yarn and of a ring-spun yarn, having an excellent and useful homogeneous structure. The invention also relates to a method and apparatus for producing the same.

Heretofore, spun yarns have been made by twisting all of the bundled fibers and wrapping these fibers. Special wrapped spun yarns have been made by wrapping the surfaces of parallel fiber bundles at a large twisting angle and bundling these fibers. They have also been made by bundling fiber bundles or by using an adhesive, or by fusion among the fibers.

On the other hand, it has been known that a knitted or woven fabric of a spun yarn having no twist at all, namely, a non-twisted spun yarn, has a soft feel or "hand". However, in the case of a knitted or woven fabric of a spun yarn produced by the so-called reforming method of non-twist spinning, only various difficulties are encountered in knitting or weaving and dyeing, because this method utilizes a bundling means, using an adhesive or fusion among the fibers. Also the hand of the resulting fabric has not necessarily been satisfactory.

For example, U.S. Pat. No. 3,079,746 provides a fasciated spun yarn which has surface fibers assuming an irregular helical arrangement, the helices being at various angles within the range of 10°– 80° around a substantially non-twisted core bundle. They are arranged in a disorderly manner along the core bundle and are tightly twisted around it. In said fasciated spun yarn, there are portions that are considerably tightly wrapped and other portions in which there is no wrapping. Parallel fiber bundles come out only on the surface, and all of the other portions are relaxed. In the wrapped portion, the wrapping fibers assume a disorderly and irregular helical arrangement, therefore, fluctuations of the surface and cross-sectional configurations of the spun yarn are remarkable. Further, such unevenness of appearance is brought about as to become a qualitative defect when the spun yarn is knitted or woven into a fabric. Also, in knitting or weaving, the wrapping fibers tend to relax and to move. Therefore, fasciated spun yarn has been limited in use to items having functional defects such as occurrence of nap or frequent yarn breakage due to slipping of fibers, and the fluctuation ratio of its strength is great.

A primary object of the present invention is to provide a helically wrapped yarn having substantially the merits of non-twisted spun yarns, yet having excellent general utility and a consistent and homogeneous structure.

Another object of the present invention is to overcome the defects of conventional wrapped spun yarns, and of conventional methods of making the same.

Still another object of the present invention is to provide a method for efficiently making a spun yarn having a novel structure in general utility, like that of conventional ring-spun yarns.

Specifically, the present invention has a novel and excellent structure, as will now be explained. The wrapped yarn comprises a bundle of substantially non-twisted core fibers (consisting mainly of staple fibers) and surface fibers wrapped around the bundle of core fibers. The wrapped fibers comprise the surface layer of the bundle of core fibers, while said wrapped fibers are in a generally helical arrangement with a substantially constant and regular twist angle, and are positioned in an orderly way, continuously along the bundle of core fibers.

The wrapped yarn of the present invention differs sharply from the fasciated yarn described in U.S. Pat. No. 3,079,746 invented by Frederic C. Field, Jr., which is wrapped yarn whose main constitutional requirements and characteristics reside in that its surface wrapped fibers form "irregular helices of varying helix angle randomly twisted about" and are the core bundle in a disorderly manner, which is entirely different in technical purpose from a wrapped yarn having a regular homogeneous structure, which is the object of the present invention.

Further, in a sheaf yarn which is described in Japanese Patent Application Publication No. 10511/1961, the end of one bundle of staple fiber yarns contacts the end of another bundle of staple fiber yarns lengthwise of such bundles. At irregular intervals, surface wrapped staple fibers are tightly twisted around such bundles. Although there is no description in the reference regarding the specific angle of the surface wrapped fibers, judging from the drawings it appears that the surface wrapped fibers form irregular helical wraps of various angles and are positioned in a disorderly fashion along the bundle of core fibers.

The novel yarn according to this invention is a united spun yarn having a homogeneous structure in which surface wrapped fibers form helices that are arranged in a substantially constant direction at a regular twisting angle, and are wrapped around the bundle of core fibers substantially continuously and in an orderly way.

In the helically wrapped spun yarn according to the present invention, the bundle of core fibers is preferably composed of 100% staple fibers. However, it may be mixed with continuous filaments and spun yarn as occasion demands. The staple fibers wrapped around the bundle of core fibers do not cover the entire bundle of core fibers uniformly so that the bundle of core fibers become invisible, but they do wrap around the bundle of core fibers helically at a substantially constant pitch along the length of the yarn, with some spacing so that some fibers of the bundle of core fibers appear on the surface of the yarn. When the arrangement of the wrapped fibers around the core fiber bundle is observed, at least about 60% of the fibers wrap around the bundle of core fibers as a bundle of 2 – 6 staple fibers and the remaining fibers wrap in the form of a single staple fiber, or as a bundle of more than 6 staple fibers. At least about 70% of the wrapped fibers have a helix angle in the range of about 20°– 40° in a constant direction.

The coefficient of variation of intervals of the wrapped positions of the wrapped fibers along the core bundle is referred to as the CV% and is expressed as the average of the deviations divided by the average value of spacing and is usually less than about 60%. Further, at least about 90% of the wrapped fibers wrap around the bundle of core fibers as a helix, and in a constant direction.

The wrapped yarn of the present invention has a strength coefficient of variation (CV %) which is less than about 20%, which is about the same as that of a spun yarn obtained by conventional ring spinning, and which has a twisting torque in a constant direction.

The following method is used for obtaining a wrapped yarn having a homogeneous structure according to the present invention. After drafting a bundle of fibers composed mainly of staple fibers, or naturally occurring discontinuous fibers, or fibers prepared from continuous filaments by cutting or stretch-breaking, the fibers are supplied to nip rollers and false twist is imparted to the bundle of fibers. Then a bundle of fibers comprising majority of false twisted staple or discontinuous fibers and a minority of outside fibers free from said false twist and separated from the bundle of false twisted fibers but arranged substantially parallel to the bundle of false twisted fibers, are fed concurrently substantially parallel and are united in a false twisting zone, after the outside fibers are separated from each other and the two ends of the outside fibers become free.

At this time, it is preferred to use a twist constant K (expressed in meters) of at least 100 in the false twisting of the bundle of fibers, preferably 150 – 350. It is preferred to unite the outside fibers with the bundle of false twisted fibers at a certain position, proceeding from the nip point to which the bundle of fibers is supplied. In other words, it is preferable to unite the two without irregularly changing the uniting position of the outside fibers with respect to the position of the bundle of false twisted fibers, but at a specified position at a certain distance from the nip point to which the bundle of fibers is supplied. Further, it is preferable for making the wrapped yarn of the present invention to cause the outside fibers to proceed straight ahead without changing the position to which the bundle of fibers is forwarded from the nip point to which the bundle of fibers is supplied, and to cause the outside fibers and the bundle of false twisted fibers to proceed at about the same speed.

The wrapped yarn of the present invention is made for the first time by providing means for supplying a bundle of drafted staple or discontinuous fibers to a nip, means for imparting false twist to said bundle of fibers, means for advancing and transferring straight ahead a group of outside fibers without obstructing transmission of false twist to said nip point between the two means, and means for uniting the two groups in a false twisting zone after the outside fibers are separated from each other and both ends thereof become free. In the foregoing apparatus it is preferred to use, as the transfer means of the outside fibers, an endless belt (apron) advancing and transferring the outside fibers straight ahead from the nip point to which the bundle of fibers is supplied, without obstructing the transmission of false twist to the nip point. The endless belt may be supplied at the bottom only, if desired. However, it usually comprises a pair of top and bottom endless belts and the tips thereof are open to the extent of not obstructing the transmission of false twist to the nip point to which the bundle of fibers is supplied. In this case, the pair of endless belts may be adjoined to the front nip rollers of a drafting zone or one end of the pair of belts may be rotatably arranged around the front nip rollers as a supporting axis. It is preferable that the endless belt has a length to such an extent that both ends of the mutually separated outside fibers become free.

It is preferable that the means for uniting the outside fibers with the bundle of false twisted fibers include a suction means through which the bundle of false twisted fibers and the mutually separated outside fibers can pass linearly, and that the suction means include a passage having sufficient narrowness for the outside fibers to be united with the bundle of false twisted fibers. Said suction means is more useful when it is connected to withdraw the fibers at the time of yarn breakage using an air current.

Any usual false twisting apparatus is usable. However, a false twisting spindle having pegs and a fluid eddy nozzle turning a fluid to impart false twist thereto is effectively used. It is preferable that said fluid eddy nozzle be so designed as to false twist the fiber bundle and at the same time to apply suction. Further, it is preferable that the fluid eddy nozzle having suction be connected to and united with the aforementioned suction means uniting the outside fibers with the bundle of false twisted fibers. A fluid eddy nozzle having suction is provided such that the distance from the nip point to which the bundle of fibers is supplied to the fiber bundle inlet of the nozzle is at least the average fiber length, but at most two times the average fiber length.

Because the apparatus of the present invention has such a structure, many materials are suitable for making wrapped yarns of the present invention. Natural fibers such as cotton, wool, silk, lamie, flax, jute, hemp and the like, and synthetic fibers such as polyamides, polyesters, polyacrylenes and polyolefines, and the like, semi-synthetic fibers, regenerated fibers, metal fibers, glass fibers and the like and mixtures of these fibers are usable. Further, the fiber length, fineness (denier per filament) and cross sectional configuration of these fibers are not limited. As regard the spinning count, there is no limitation to spinning yarns of a superfine count of about 1/200, intermediate counts of about 1/48 and extra coarse counts of 1/4. In short, it is possible to provide spinning technologies of great general utility by the present invention.

In order to present the present invention more clearly, further explanations will be made by reference to the drawings.

DRAWINGS

Figure 9:
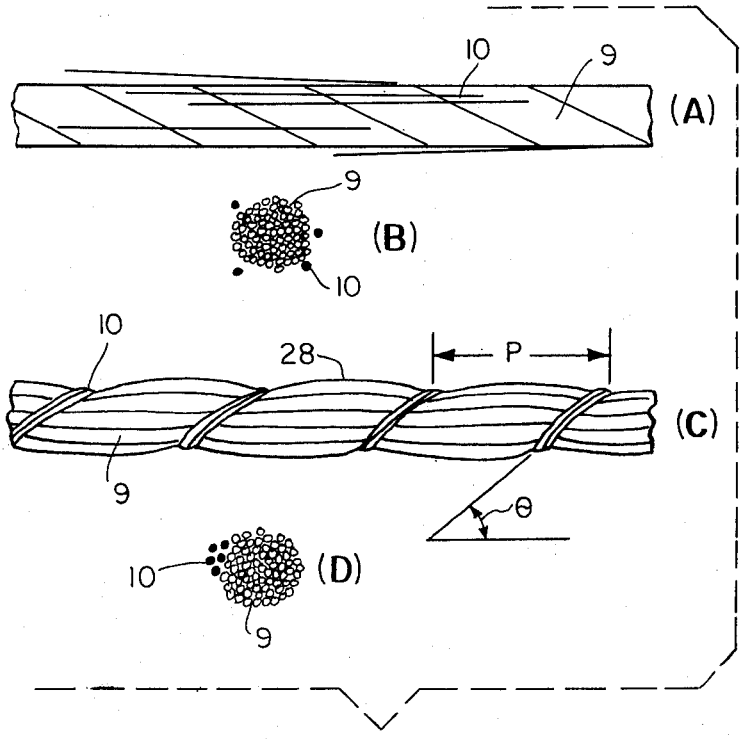

FIG. 9 (A) is a sketch showing the relationship of a bundle of false twisted fibers with outside fibers, immediately before they pass into a false twisting device. FIG. 9 (B) is a view in section through FIG. 9 (A). FIG. 9 (C) is a view of a wrapped yarn according to the present invention. FIG. 9 (D) is a view in section through FIG. 9 (C).

Figure 10:
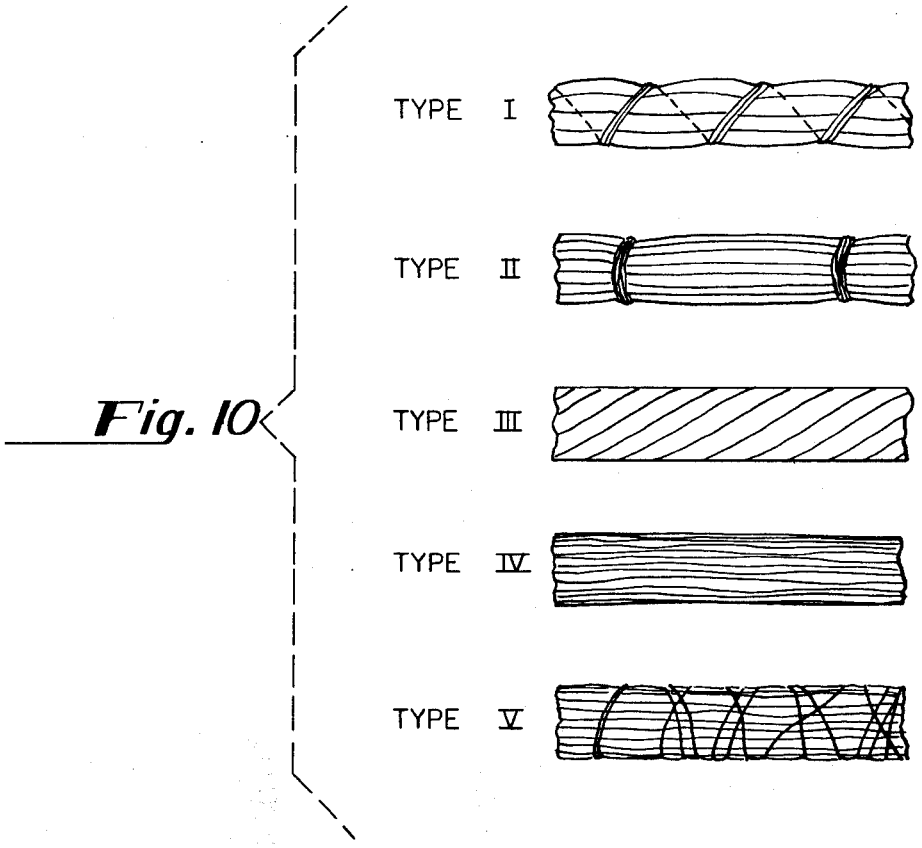

FIG. 10 is a schematic view showing the structures observed in conventional fasciated yarns and in wrapped yarn of the present invention.

Figure 11:
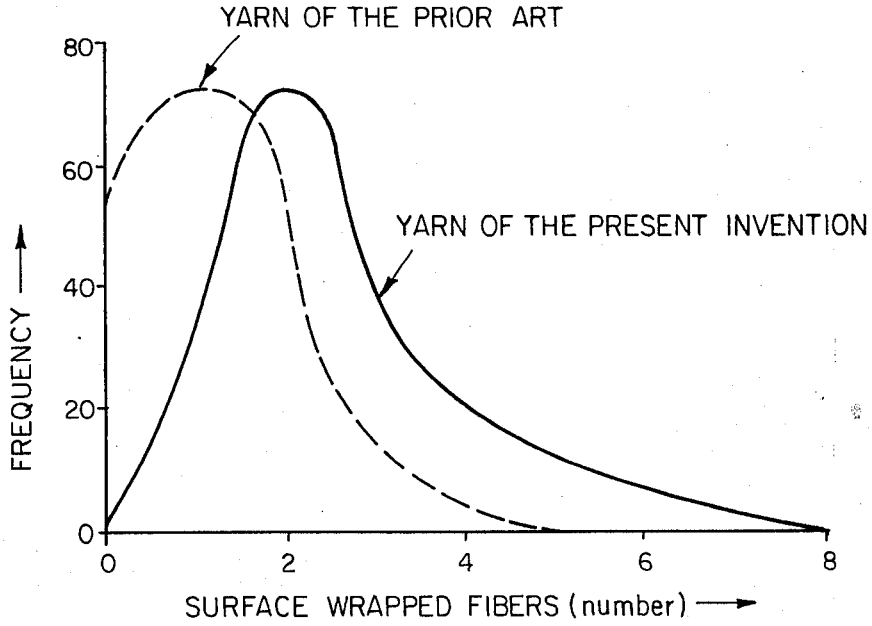

FIG. 11 is a graph showing the relationship between the number and frequency of surface wrapped fibers of conventional fasciated yarns and wrapped yarns of the present invention.

Figure 12:
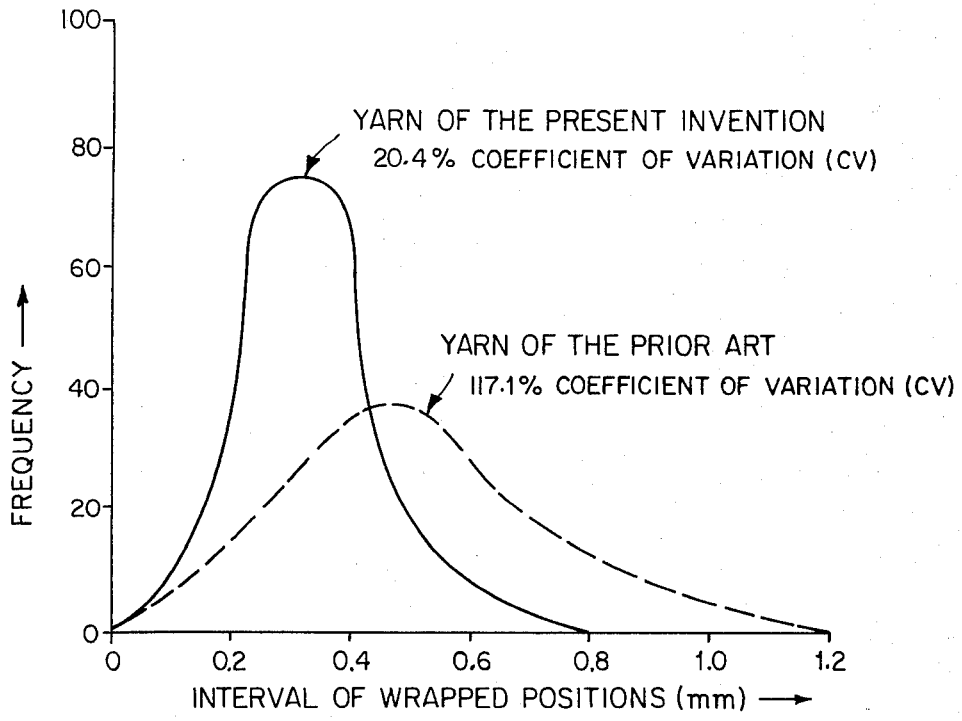

FIG. 12 is a graph showing the relationship between the intervals and frequency of wrapped positions of surface wrapped fibers of conventional fasciated spun yarn and wrapped yarn of the present invention.

Figure 13:
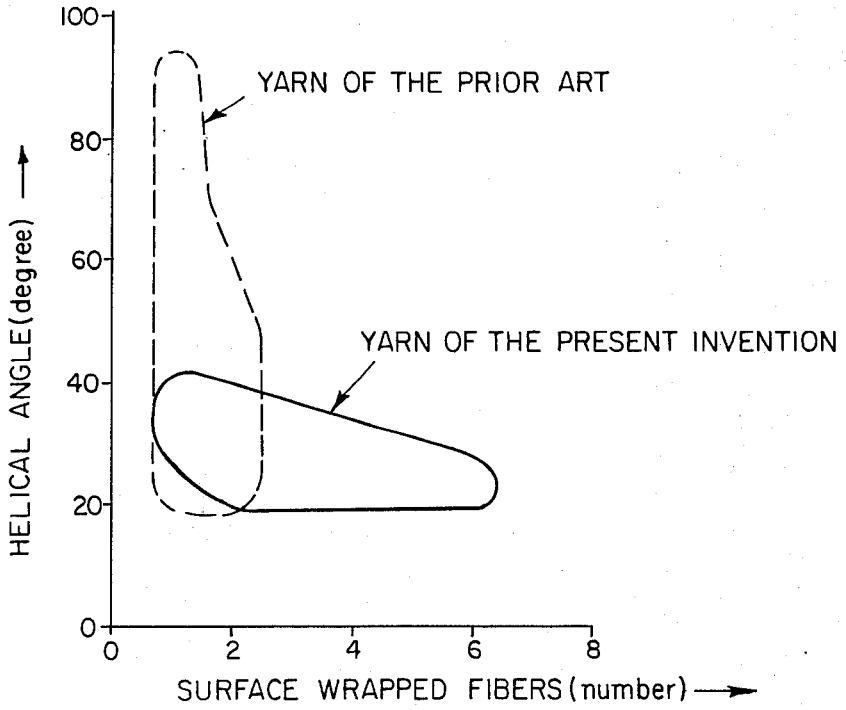

FIG. 13 is a graph showing a distribution relationship wherein the number and helical angle of surface wrapped fibers of conventional fasciated yarn and wrapped yarn of the present invention are shown as abcissa and ordinate, respectively.

Figure 1:
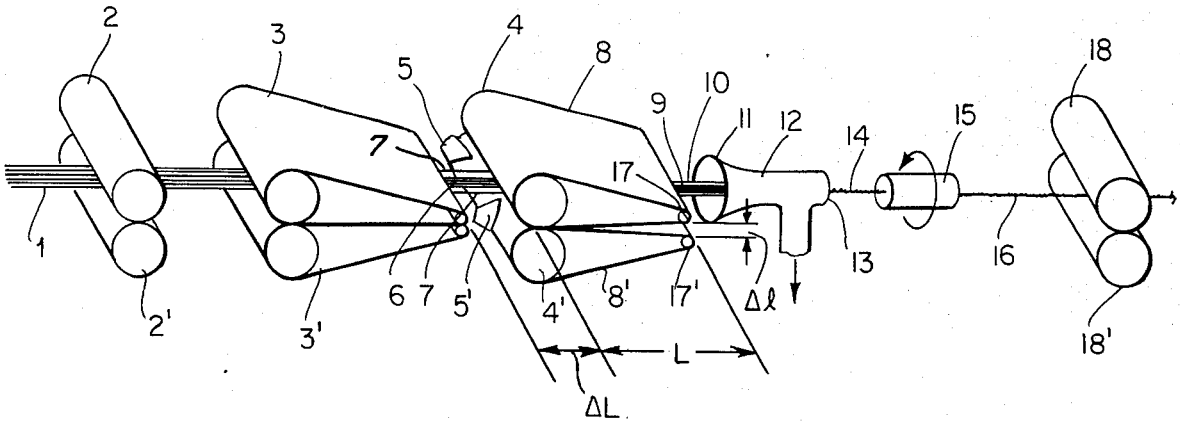
FIG. 1 is a perspective view of a production process showing one embodiment of the present invention.

Referring now to FIG. 1, a bundle of staple fibers such as roving or sliver 1 is drafted to a proper thickness by a conventional drafting apparatus comprising back rollers 2, 2′ a pair of top and bottom aprons 3, 3′ and front rollers 4, 4′. A pair of transfer aprons 8, 8′ on said front rollers 4, 4′ is so provided that these aprons gradually open toward their downstream ends or tips. This gradual opening of said aprons 8, 8′ in a downstream direction avoids obstructing transmission of false twist which is imparted to the bundle of drafted fibers by a rotating false twist spindle 15 located downstream of the front rollers 4, 4′. The false twist extends upstream from spindle 15 to the nip point that is formed by front rollers 4, 4′.

It is important upon drafting a bundle of fibers in the present invention to set up a gap which extends through the distance ΔL from the downstream ends of the aprons 3, 3′ to the nip line of the front rollers 4, 4′. Specifically, the free gap is preferably maintained at about 15 – 30 mm. With the provision of this gap, the bundle of fibers moving from the aprons 3, 3′ to the front rollers 4, 4′ encounters the action of an air current caused by the front rollers 4, 4′. Some outside fibers 7, 7′ are accordingly separated under the influence of this air current and are positioned outwardly with respect to the position of the main bundle. On the other hand, the majority of the fibers become a bundle 6 which is taken up toward the front rollers and is then twisted upon passing through the nip of the front rollers 4, 4′. It is desirable to provide collector guides 5, 5′ for preventing the outwardly located separated fibers from separating in an outward direction more than is necessary, in the area between the downstream ends of the aprons 3, 3′ and the nip of the front rollers 4, 4′. However, this is not necessarily an indispensable requirement.

Separated outside fibers 7, 7′ in accordance with the present invention are obtained by the aforementioned means. The number of outside fibers so separated is controlled by the length ΔL of the aforementioned free gap, and by the peripheral speeds of the front rollers, which influence the intensity of the aforementioned air current. A desirable number of the outside fibers 7, 7′ is 1–10 staple fibers, desirably 2–6 staple fibers. When the number of outside fibers exceeds 10 staple fibers, the outside fibers interfere with one another and it becomes difficult to unite the outside fibers while maintaining them in a separated condition with respect to the central bundle of false twisted fibers. Therefore, it becomes difficult to obtain a wrapped yarn having a homogeneous structure. Other primary factors concerning the number of outside fibers are physical characteristics including rigidity of the fiber material, fiber length, denier, shape of fiber and surface of fiber. Further factors include the bundled state of fibers and the number of twists in a bundle of fibers upon being supplied to a drafting apparatus, as well as the drafting system, draft ratio and accessories supplemental to the drafting apparatus such as the trumpet, condenser, collector and the like.

Again, returning to FIG. 1, as soon as the drafted fibers pass through the nip line of the front rollers 4, 4′, a majority of the bundle of fibers 6 is false twisted by the action of the false twisting device 15, and the fibers advance as a bundle of false twisted fibers 9 between a pair of top and bottom transfer aprons 8, 8′ having an interval therebetween. On the other hand, the relatively few outside fibers 7, 7′, separated from the bundle 9, are not restricted into bundle 9. After passing through the nip rollers 4, 4′, free fibers 7, 7′ are advanced and transferred straight ahead as they are in a mutually separated arrangement on the transfer apron 8 at both outer sides of the bundle 9 of false twisted fibers.

One of the important constitutional requirements for obtaining a wrapped yarn having a homogeneous structure according to the present invention resides in providing a certain transfer means for the outside fibers as mentioned above. In this respect the wrapped yarn and method of this invention are different from conventional fasciated yarns and methods of making the same. This makes it possible to obtain drastically improved yarn quality and spinning stability.

The gradual opening of the transfer aprons 8, 8′may be adjusted to such an extent that transmission of false twist to the bundle of fibers to the nip point of the front rollers 4, 4′ is not obstructed. An opening which is larger than that is not required. In an ordinary case, the interval ΔL at the tip of the transfer aprons 8, 8′ may have a range of about 3 – 10 mm. However, the present invention is not necessarily limited thereto. The transfer aprons 8, 8′ are placed under proper tension in their respective tips by rotatable axes 17, 17′ supported by bearings. As the front rollers 4, 4′ rotate, the aprons 8, 8′ are driven and rotated. The nip of the front rollers 4, 4′ apparently forms a nip in cooperation with the aprons 8, 8′.

The working length L of the transfer aprons 8, 8′ may be any length having sufficient effect for making both ends of the aprons 8, 8′ free while the outside fibers advance substantially parallel to the bundle of false twisted fibers without being interfered with and restricted into the bundle of false twisted fibers, and with the outside fibers mutually separated until the outside fibers are united with the bundle of false twisted fibers. This effect is determined relative mainly to the fiber length of the fiber being used, and L is at least one half the average fiber length of the outside fibers, preferably at least as much as the average fiber length of the outside fibers.

As the bundle of false twisted fibers 9 and the outside fibers 10 advance in the space between the transfer aprons 8, 8′, the outside fibers 10 unite with the bundle of false twisted fibers 9 while the former is arranged substantially parallel to the latter. In order to cause such uniting action, various unrestricted means may be utilized, such as mechanical means, electrical means or means utilizing fluid flow. FIG. 1 shows an example using a suction tube 12, specially shaped, utilizing air suction, an enlarged view of which is shown in FIG. 2.

Figure 2:
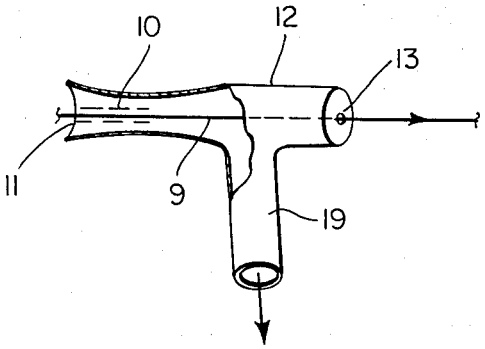
FIG. 2 and FIG. 3 are enlarged views showing means for uniting outside fibers with a bundle of false twisted fibers.

In FIG. 2, a bundle of fibers is shown passing through the suction tube 12. The inlet opening 11 (suction portion) is designed as a considerably larger opening than the outlet opening 13. Accordingly, a strong current of suction air exists at the inlet, thereby imposing a strong suction effect on the outer, non-twisted staple fibers 10 supplied from the front rollers. A branch pipe 19 extending from the side of tube 12 is connected to a conventional suction apparatus (not shown); when yarn breakage occurs, the staple fibers are drawn from the suction inlet and pass through the branch tube 19 and into a pneumatic collecting box (also not shown).

Further, and this is important, when the outer fibers 10, released from the aprons during spinning are pulled by the current of air into the suction tube 12 in an unrestricted manner with both ends free, this draws the fibers to the twisted bundle 9 and they are thereby united. For that purpose, it is desirable to provide all or part of the inner diameter zone of the suction tube 12, from the suction inlet to the branch 19, in a diameter of about 3 – 15 mm. (in the case of a fine yarn count, the inner diameter should be rather small, while in the case of a coarse yarn count, it should be much larger). Thus, the inside diameter of the tube 12 is varied in accordance with the diameter or count of the spun yarn. The suction pipe from the suction inlet of fibers to the branch tube should be provided in a sufficient length, desirably 3 – 30 mm.

It is desirable to cause the bundle of fibers to vibrate while they are in the process of being formed, while passing through the suction tube. The fibers should be caused to vibrate and to balloon, irrespective of whether they carry a positive or negative charge. Further, because the suction angle of the suction pipe of the present invention is in the direction of advancement of the yarn being spun, the suction efficiency is remarkably good even with a relatively weak current of suction air, resulting in a drastic decrease of "flies" and of "laps" with the fibers lapping around the aprons. At the same time, this achieves the purpose of uniting the outside fibers with the bundle of false twisted fibers at a certain position.

Figure 3:
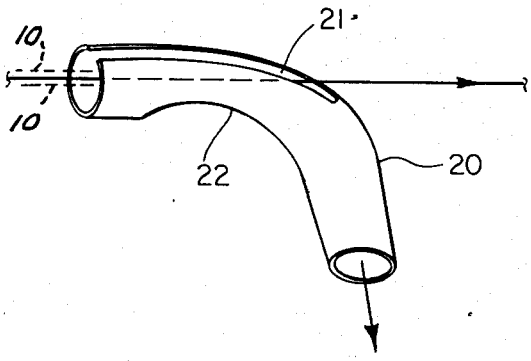

FIG. 3 shows another example of a suction pipe according to the present invention, in which one end of the pipe 20 (in the direction of the arrow mark) is connected to a suction apparatus. A thin slit 21 is formed on the upper surface of the suction pipe facilitating passing a bundle of false twisted fibers through the suction pipe 20. A smaller diameter portion 22 of the suction pipe 20 has the functional effect of facilitating uniting of the outside fibers 10 with the bundle of false twisted fibers.

Figure 4:
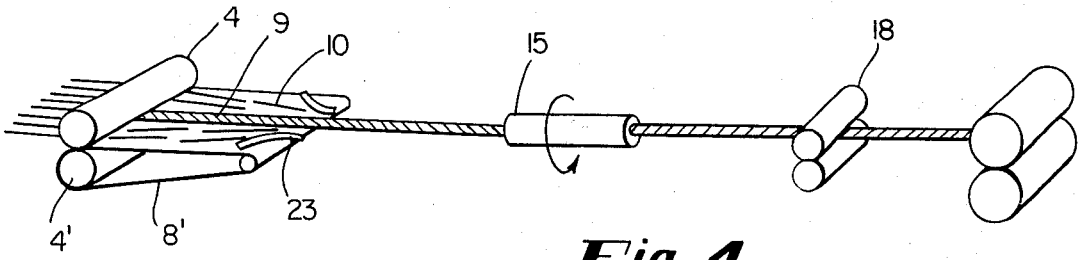
FIG. 4 is a perspective view of a production process showing another means for uniting outside fibers with a bundle of false twisted fibers.

FIG. 4 shows another means for uniting the outside fibers 10 with the bundle of false twisted fibers, in which the outside fibers 10 in a both-ends-free condition are transferred by a transfer apron 8' at the same speed as the bundle of false twisted fibers 9, and around the same bundle of false twisted fibers, and guided by a collector 23, which is provided at a distance from the nip point which is at least as great as the average fiber length of the both-ends-free staple fibers. This assures contact and union of the outside fibers 10 with the surface of the bundle of false twisted fibers 9.

Again referring to FIG. 1, the bundle of fibers 14 as it exists immediately before passing through the false twist apparatus, as shown in FIGS. 9 (A) and (B), has outside fibers 10 which adhere, in a weakly restricted state, to the surface of the previously twisted bundle 9. They are merely adhered to the surface and are by far less twisted than the bundle of fibers 9 and are not in a tightly twisted state. The number of outside fibers 10 at this point is, in any section taken through the bundle of fibers 9, about 1 – 10 usually about 2 – 6. At the same time, the outside fibers 10 exist in a disorderly array along the surface of the bundle of false twisted fibers 9.

Returning to FIG. 1, as soon as the bundle of fibers 14 passes through the false twisting point of the false twist apparatus, it becomes detwisted. As a result, the bundle of false twisted fibers 9 becomes substantially free of twist. By microscopic observation, they appear to be in such condition that they have alternate twist first in the S direction and then in the Z direction. On the other hand, the outside fibers 10 which are located on the surface of the bundle 9, as shown in FIGS. 9(A) and 9(B), are subjected to substantial twisting by the detwisting action of the other fibers.

During the process, the bundle of false twisted fibers 9 tends to extend due to detwisting, to an extent equivalent to the amount of twist shrinkage. On the other hand, the outside fibers 10 the surface layer of the bundle of false twisted fibers 9 are subjected to a reverse helical wrapping action. Therefore, the outside fibers 10 are tensioned by twist shrinkage. The results of these entirely opposite actions, applied to the core fibers 9 and the wrapped fibers 10, are shown in FIGS. 9 (C) and (D). The outside fibers 10 shift from their initial disorderly positions on the surface of the bundle 9 to cohere into a most orderly, stabilized bundle 10 and are regularly and continuously wrapped around the surface of the bundle of substantially non-twisted fibers 9. On the other hand, the bundle of false twisted fibers (core fibers) 9 tends to form protrusions 28, because of the aforementioned slackening of tension, between the regular pitches of the tightly wrapped fibers 10 stabilizing them. As is shown in FIG. 9(D), the wrapped outside fibers 10 remain on the surface of the core 9 and do not penetrate or extend into the core 9. Such phenomon of "transfer of the outside fibers" is a remarkable characteristic of the present invention, and is achieved for the first time by separating and transferring the outside fibers in a both-ends-free condition and uniting the same with the bundle of previously false twisted fibers in an arrangement substantially parallel to the bundle axis and weakly restricted, namely, by precisely controlling the outside fibers which are originally in an unstable condition. Therein lies a reason why a wrapped yarn of the present invention is called a helically wrapped yarn having a homogeneous structure.

In FIG. 1, a wrapped yarn 16, obtained after passing through the false twisting apparatus 15, is wound around a winder (not shown) to form a package as a final product, via take-up rollers 18, 18'.

The false twist imparted to the bundle of fibers according to the present invention may be imparted by mechanical false twisting such as a false twisting spindle having pegs for example, or using an inscribing or circumscribing type friction false twisting device. Good results are also obtained by methods utilizing a high speed fluid eddy currents.

Figure 5:
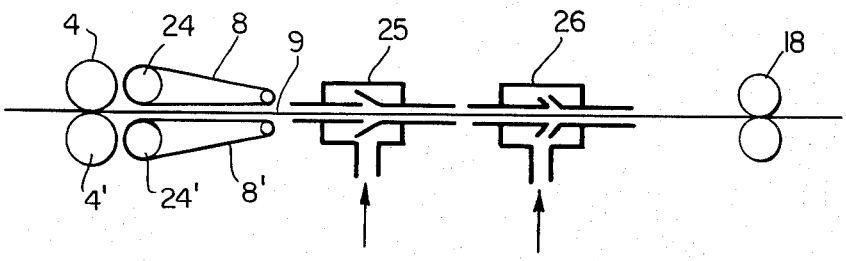
FIG. 5 and FIG. 6 are schematic views of production processes showing other embodiments of the present invention.

FIG. 5 is another embodiment of the present invention utilizing compressed air. A bundle of drafted, oriented and opened staple fibers is supplied to nip rollers 4, 4'. This bundle of fibers is transferred by use of a transfer apron having a gap, as shown in FIG. 5, comprising aprons 8, 8' driven by rollers 24, 24'. At the same time, false twist is applied by a fluid turning eddy nozzle 26, so that the false twist is transmitted as far as the nip point of the nip rollers 4, 4'. The both-ends-free outside fibers transferred by the transfer aprons 8, 8' are collected by a collector consisting of a suction nozzle 25, provided at a position spaced away from the nip point. This spacing is as least as great as the average fiber length of the staple fibers. The added outside fibers are distributed around the bundle of false twisted fibers 9 and guided for contact and union with the bundle of false twisted fibers 9. The fluid turning eddy nozzle 26 and the suction nozzle 25 are connected to compressors, respectively, into both of which compressed air is forced in the direction as indicated by the arrows appearing in FIG. 5.

Figure 6:
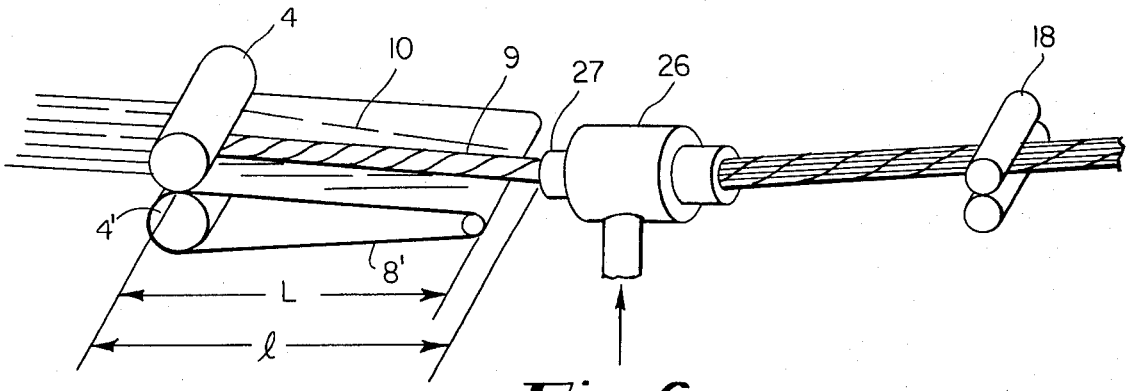
Figure 7:
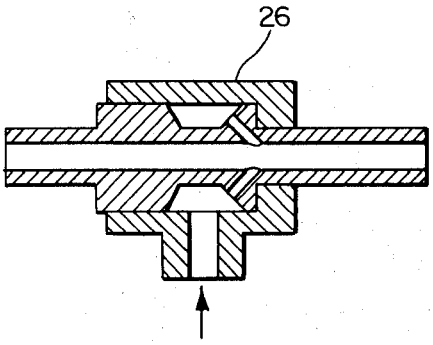
FIG. 7 is a side elevation in section of a fluid eddy suction nozzle.

FIG. 6 is a view of a production process showing still another embodiment of the present invention, in which a fluid turning eddy nozzle 26 having a suction action, a section of which is shown in FIG. 7, is provided at a position spaced away from the nip point of the nip rollers 4, 4' with respect to the fiber inlet 27 of said nozzle, by a distance $l$ (which is at least as great as the average fiber length of the supplied staple fibers).

When the distance $l$ is too great, the fibers that are intended to be twisted are instead immediately pulled apart at the time of starting or re-starting spinning. This causes breakage of the bundle of fibers, and the fibers become "flies" and scatter around. Therefore, in starting up, it is sometimes necessary simultaneously to feed an auxiliary continuous yarn, such as a filament yarn. According to the present invention the value of $l$ is preferably smaller than twice the average fiber length, so that the staple fibers may be sucked automatically and turned by the nozzle, and immediately formed into a coherent twisted mass which maintains its identity even without the use of any auxiliary continuous filament yarn. It is possible to control the distance from the discharge end of the fee apron 8' (the top apron of which is not shown) to the fiber inlet of the nozzle so that it is less than one-half the average fiber length. In this way, it is possible to prevent generation of waste fibers and "flies", and is also possible immediately to suck the fibers from the apron to the nozzle. Further, the distance L from the nip point of the nip rollers to the downstream end of the feed apron should be about 0.5 – 2 times the average fiber length.

Figure 8:
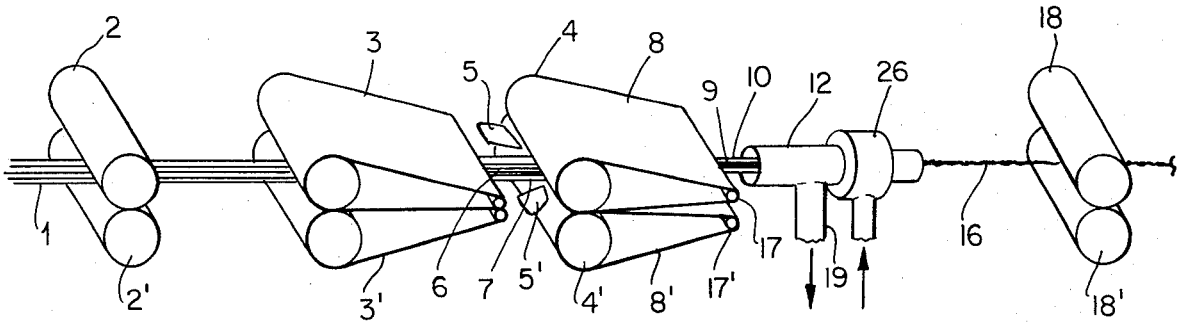
FIG. 8 is a perspective view of a production process showing still another embodiment of the present invention.

FIG. 8 is a perspective view of a production process showing still another embodiment of the present invention. This is an example showing the idea of integrally connecting the fluid turning eddy nozzle 26 shown in FIG. 7 to a suction pipe such as one shown in FIG. 2. In this case, it is possible to reinforce the suction strength of the fluid turning eddy nozzle 26 by the suction pipe. Because of that, in the case of outside fibers 10 which are rather extensively separated in the direction of the width of the transfer aprons 8, 8', it is possible easily to unite the same with a bundle of false twisted fibers 9. And further, the operation of the apparatus upon starting spinning is simplified. Specifically, in this case, it is preferable that the suction inlet of the fluid turning eddy nozzle should extend to the vicinity of the branched pipe connection to the suction apparatus (not shown) in the suction pipe. Further, it is preferable to provide an auxiliary machine capable of temporarily cutting off the suction air current midway of the pipe (not shown) connecting the branched pipe to the suction apparatus. A still further effect is that when yarn breakage occurs in front or in the rear of the fluid turning eddy nozzle, it is possible to suck the fibers from the branched pipe 19 into the suction apparatus.

It is possible to vary the structure in terms of appearance of the wrapped yarn of the present invention considerably and extensively by using an overfeed ratio at the false twisting portions, specifically the relationship between the fiber feed speed under the influence of front rollers 4, 4' and the take-up speed under the influence of the take-up rollers 18, 18'. The overfeed ratio is equal to the peripheral speed of the front rollers minus the peripheral speed of the take-up rollers divided by the peripheral speed of the front rollers. The amount of false twist imparted to the bundle of fibers fed from the front rollers can also be varied to vary the structure of the yarn.

When the overfeed ratio is small (for example, below 3%) and the degree of false twisting is relatively small,(for example, a twist constant $K$ = about 150 – 200), $T = K \sqrt{Nm}$ (Nm; metric yarn count, $T$ = amount of false twist per meter), the twisting angle $\theta$ of the fibers 10 in the yarn structure shown in FIG. 9 (C) becomes small and the degree of protrusion 28 of the bundle of core fibers 9 tends to be small, and the yarn product tends to have a relatively smooth surface. On the contrary, when the overfeed ratio is controlled so that it is rather large (for example, about 10%), and the degree of twisting is relatively high (for example, a twist constant $K$ of about 300), the twist angle $\theta$ of the outside fibers 10 in the yarn structure shown in FIG. 9 (C) becomes large and the protrusion 28 of the bundle of core fibers becomes large, in which case the yarn develops an uneven appearance which is suitable for products in which a harsh hand is desirable.

Because they have structures as mentioned above, wrapped yarns obtained according to the present invention have the following characteristics:

1. Strength: high. Coefficient of variation (%) of strength: equal at least to ring-spun yarns.
2. Twisting torque in one direction: the same as or somewhat less than that of a ring-spun yarn.
3. Degree of orientation of fibers: good.
4. Stabilized against (frictional effects) at guides, reeds and tension devices.
5. Number of naps: few. Length of naps: short.

Further, from the viewpoint of the method for making it, the wrapped yarn of the present invention has the following characteristics:

1. Yarn breakage seldom occurs, and spinnability is stable even in high-speed spinning.
2. There is no limiting requirement regarding the fiber material supplied, the range of spinnability is broad, it is possible to spin yarns having very fine to very coarse thicknesses or counts, and the general utility of the process is great.
3. High-speed driving is easily attainable.
4. Fibers are almost free of damage upon being spun.
5. The apparatus is simple and compact.
6. Even using high-speed spinning, energy consumption (electric power)is small.
7. It is possible to obtain spun yarns having broad ranges of characteristics by simple changes of spinning conditions.
8. The amount of "flies" obtained is small.

Hereinbelow, the present invention will be explained by reference to specific examples. However, the present invention is not intended to be limited to these examples.

EXAMPLE 1

A wrapped yarn was spun, using the embodiment shown in FIG. 1. Also, for purposes of comparison, a yarn of the prior art (U.S. Pat. No. 3,079,746)was also spun under the following conditions:

| | FIG. 1 | Prior Art |
|---|---|---|
| Starting Material | Nylon 6 1.5 d × 190 mm V roving | Same as next column |
| Spinning count | 1/100 | " |
| Total draft ratio | 30 | " |
| Spacing L (mm) | 15 | " |
| Collector regulated width (mm) | 19 | " |
| Speed of front rollers (m/min) | 115 | " |
| Take-up speed (m/min) (take-up rollers) | 110 | " |
| Working length (L) of transfer aprons × width (mm) | 145 × 32 | " |
| Interval Δ l at tip of transfer aprons, (mm) | 8 | — |
| RPM of false twist spindle | 230,000 | — |
| Pneumatic pressure (kg/cm²) | — | 3.5 |
| Eddy nozzle (Torque jet nozzle) | — | {air passage diameter} × {number of holes} |
| | | 0.3 mm × 8 H |
| | | Yarn passage diameter 1.6 mm |
| Aspirator | — | Air passage diameter × number of holes |
| | | 0.5 mm × 4 H |
| | | Yarn passage diameter 2.0 mm |
| Sucking pipe | Minimum diameter of the yarn passage 6 mm | — |
| Suction strength (mm Aq) | 80 | — |

According to the method of the present invention, a good spun yarn was obtained under the aforementioned conditions. However, according to the prior art, the yarn broke frequently.

The important characteristics of the resulting yarns are shown in the following table.

| Characteristics | Yarn of the present invention | Yarn of the prior art |
|---|---|---|
| Count Nm | 1/85.9 | 1/84.7 |
| Strength (g) | 322.0 | 229.2 |
| Product of count and strength (Sg) | 16346.9 | 11500.3 |
| Elongation (%) | 20.0 | 15.5 |
| Tensile strength (g/d) | 3.07 | 2.16 |
| Coefficient of variation ratio of strength (%) | 14.7 | 30.8 |
| Maximum strength (g) | 440 | 399 |
| Minimum strength (g) | 190 | 70 |

*Method of measuring tensile strength and elongation:

| | | |
|---|---|---|
| (1) | Sample size | N = 100 |
| (2) | Measuring apparatus | Uster automatic tensile strength and elongation testing apparatus |
| (3) | Sample Length | (50 mm) |
| *Coefficient of variation ratio | = | (Standard deviation σ/average value) × 100 (%) |

The yarn of the present invention exhibited characteristics that were completely free from problems in actual use. However, in the yarn of the prior art, there was a remarkably large coefficient of variation ratio of strength. Further, the minimum strength was low, slipping of fibers occurred and it showed problems in actual use.

Further 2 m each of the resulting yarns of the two systems were sampled and the yarn structure of 200 places at regular intervals were enlarged under a microscope and investigated.

At first, the yarn structures contained in the yarns of the two systems could be classified into 5 types as shown in FIG. 10.

| Type | Content |
|---|---|
| I | continuous wrapping |
| II | partial wrapping |
| III | partial true twist of the fiber bundle (S or Z) (no wraps) |
| IV | complete lack of twist |
| V | complicated wrapping |

The frequency of appearance of each of these types in the yarns of the two systems appears in the following table.

| Kind of yarn | | Type I | II | III | IV | V |
|---|---|---|---|---|---|---|
| Yarn of the present invention | (point) | 196 | 0 | 2 | 0 | 2 |
| | ( % ) | 98 | 0 | 1 | 0 | 1 |
| Yarn of the prior art. | (point) | 116 | 20 | 32 | 22 | 10 |
| | ( % ) | 58 | 10 | 16 | 11 | 5 |

From the results, it was demonstrated that the yarn of the present invention was of the structure of type I, i.e., the surface fibers were wrapped in a continuous helical state around the bundle of core fibers. In the case of the yarn of the prior art, structures of various types existed in admixture. Moreover, in the prior art yarns, as much as about 30% of the surface had no surface wrapping fibers at all.

In FIG. 11 and in the following table, the distribution of number of surface wrapped fibers is shown.

| Kind of yarn | | Number 0 | 1 | 2 | 3 | 4 | 5 | 6 | 7 | 8 |
|---|---|---|---|---|---|---|---|---|---|---|
| Yarn of the present invention | point | 6 | 27 | 66 | 46 | 24 | 13 | 21 | 2 | 0 |
| | % | 2.9 | 13.2 | 32.2 | 22.4 | 11.7 | 6.3 | 10.2 | 1.1 | 0 |
| Yarn of the prior art | point | 54 | 67 | 53 | 11 | 3 | 0 | 0 | 1 | 0 |
| | % | 28.6 | 35.4 | 28.0 | 5.8 | 1.6 | 0 | 0 | 0.6 | 0 |

In the yarn of the present invention, there are many places in which a plurality of fibers wrap as a bundle, and the number of places in which there is no wrapped fiber is almost zero. In the case of yarn of the prior art, there are many places in which only only one surface wrapped fiber is present, and many more places in which there is no wrapped fiber at all.

Next, the measured results of intervals P of the surface wrapped fibers are shown in FIG. 12, and expressed as distribution of frequency. It is apparent that in the case of the yarn of the present invention, wrapped fibers are located in a regular manner, whereas in the case of yarn of the prior art, wrapped fibers are located irregularly and in disarray. The coefficient of variation ratio of the intervals in the case of the yarn of the present invention is 20.4%, whereas said coefficient in the case of the yarn of the prior art is 117.1%. A large difference, of about 6 times, is recognized.

Next, measured results showing the helical angles of the surface wrapped fibers appear in the following table.

| Kind of yarn | | Helical angle (degree) 10– | 20– | 30– | 40– | 50– | 60– | 70– | 80– | 90– | 100– |
|---|---|---|---|---|---|---|---|---|---|---|---|
| Yarn of the present invention | (point) | 7 | 86 | 68 | 24 | 5 | 3 | 0 | 0 | 0 | 0 |
| | (%) | 3.6 | 44.6 | 35.2 | 12.4 | 2.6 | 1.6 | 0 | 0 | 0 | 0 |
| Yarn of the prior art | (point) | 0 | 16 | 25 | 31 | 26 | 8 | 3 | 3 | 22 | 1 |
| | (%) | 0 | 11.9 | 18.5 | 23.0 | 19.3 | 5.9 | 2.2 | 2.2 | 16.2 | 0.8 |

From the above results, it is apparent that the yarn of the present invention has little fluctuation and has a regular helical structure like a conventional ring-spun yarn.

Further, FIG. 13 relates to the helical angles of surface wrapped fibers; a comparison of the yarns of the two processes when the number of wrapped fibers and the helical angle are plotted as abscissa and ordinate, respectively. From these the technical characteristics of the respective yarns may be clearly judged.

Specifically, in the prior art, the helical angles are spread out through a broad range of 20°–90°, and the number of wrapped fibers is as low as 1 in many cases. In contrast, in the yarn of the present invention, the fibers wrap within a narrow range of dispersion of 20°–40°, and the number of wrapped fibers is a bundle of at least 2 staple fibers in greater part.

Because it has such excellent homogeneity, the wrapped yarn of the present invention is not only excellent in processability in subsequent processes such as knitting or weaving, but is also excellent in homogeneity of the product. It can achieve a high-class luster and hand, which have been difficult to achieve with conventional spun yarns.

EXAMPLE 2

A roving consisting of 1.25 $d \times 44$ mm polyester staple fiber was spun according to the embodiment shown in FIG. 4, under the following conditions.

| | | |
|---|---|---|
| (1) | Roving thickness | 0.4 g/m |
| (2) | Spinning count | 1/60 |
| (3) | Drafting method | 3-line apron system |
| (4) | Working length of feed device | 50 mm |
| (5) | Spinning speed | 50 m/min |
| (6) | Feed ratio (between nip rollers 2, 2' and take-up rollers 10 | 2.0% overfeed |

Under the aforementioned conditions, stable spinning was carried out. In the resulting spun yarn, surface fibers wrapped in a helical condition in one direction as shown in FIG. 1. The resulting spun yarn had a yarn strength of 300 g, which was sufficient for actual use.

EXAMPLE 3

A roving consisting of 1.5 $d \times 44$ mm acrylic staple fiber was spun, using the embodiment shown in FIG. 5, under the following conditions.

| | | |
|---|---|---|
| (1) | Roving thickness | 0.5 g/m |
| (2) | Spinning count | 1/52 |
| (3) | Drafting method | 3-line apron system |
| (4) | Working length of feed device | 50 mm |
| (5) | Spinning speed | 100 m/min |
| (6) | Feed ratio | 5% overfeed |
| (7) | Pressure of compressed air | 3.8 kg/cm² |

Under the aforemention conditions stable spinning was carried out and it was possible to obtain spun yarn having a homogeneous structure and sufficient strength, in which the surface fibers were wrapped in a helical state in one direction same as in Example 1 and Example 2.

EXAMPLE 4

A roving consisting of 1.5 $d \times 44$ m. "Tetoron" (trademark of polyethylene terephthalate fiber manufactured by Toray Industries, Inc. of Japan) was spun by the device shown in FIG. 7 (using the fluid turning eddy nozzle shown in FIG. 8) under the following conditions.

| | | |
|---|---|---|
| (1) | Roving thickness | 1.4 g/m |
| (2) | Spinning count | 1/60 |
| (3) | Drafting method | 3-line apron system |
| (4) | Working length of feed device | 50 mm |
| (5) | Spinning speed | 100 m/min |
| (6) | Fluid used | compressed air under 4.0 kg/cm² |
| (7) | Feed ratio | 6% overfeed |

Under the aforementioned conditions, stable spinning was carried out. The resulting spun yarn had a homogeneous structure and a yarn strength of 290 g, in which the surface fibers wrapped helically in one direction, which was sufficient for actual use.

What is claimed is:

1. A helically wrapped yarn which comprises a bundle of core fibers comprising substantially non-twisted staple fibers, and wrapped staple fibers disposed around said bundle of staple core fibers, said wrapped fibers being helically wrapped around the surface only of said core staple fibers, and being wrapped at a regular helical angle, and not extending into the bundle of core fibers, said wrapped fibers being positioned in an orderly arrangement and extending continuously along the length of the bundle of core fibers.

2. A helically wrapped yarn according to claim 1, wherein said bundle of core fibers includes a plurality of non-wrapped portions which are expanded and protrude in the direction of the diameter of the yarn.

3. A helically wrapped yarn according to claim 1, wherein at least about 60% of said wrapped fibers are present as a bundle of 2–6 staple fibers.

4. A helically wrapped yarn according to claim 1, wherein the coefficient of variation ratio of intervals between wrapped positions of said wrapping fibers (CV %) = (standard deviation $\sigma$/average value) $\times$ 100 is not more than about 60%.

5. A helically wrapped yarn according to claim 1, wherein at least about 90% of said wrapped fibers are wrapped around said bundle of core fibers in a helical manner and in a constant direction.

6. A helically wrapped yarn according to claim 1 which has a coefficient of variation ratio of strength (CV %) of not more than about 20%.

7. A helically wrapped yarn according to claim 1 which has a twisting torque in a constant direction.

8. The helically wrapped yarn defined in claim 1 wherein the wrapped fibers are under greater tension than the core fibers.

* * * * *